US011428225B2

(12) United States Patent
Okamoto et al.

(10) Patent No.: US 11,428,225 B2
(45) Date of Patent: Aug. 30, 2022

(54) MULTISTAGE COMPRESSION SYSTEM

(71) Applicant: DAIKIN INDUSTRIES, LTD., Osaka (JP)

(72) Inventors: Daisuke Okamoto, Osaka (JP); Mikio Kajiwara, Osaka (JP); Yohei Nishide, Osaka (JP); Naoto Tomioka, Osaka (JP); Masaaki Adachi, Osaka (JP); Yousuke Ohnishi, Osaka (JP); Akitoshi Ueno, Osaka (JP); Takuya Horita, Osaka (JP); Masaaki Takegami, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 17/277,687

(22) PCT Filed: Sep. 25, 2019

(86) PCT No.: PCT/JP2019/037670
§ 371 (c)(1),
(2) Date: Mar. 18, 2021

(87) PCT Pub. No.: WO2020/067195
PCT Pub. Date: Apr. 2, 2020

(65) Prior Publication Data

US 2021/0310701 A1 Oct. 7, 2021

(30) Foreign Application Priority Data

Sep. 28, 2018 (JP) ..... JP2018-185073

(51) Int. Cl.
*F04C 23/00* (2006.01)
*F04C 29/02* (2006.01)
*F25B 1/10* (2006.01)

(52) U.S. Cl.
CPC ..... *F04C 23/00* (2013.01); *F04C 29/02* (2013.01); *F04C 2240/40* (2013.01); *F25B 1/10* (2013.01)

(58) Field of Classification Search
CPC ..... F04C 23/00–003; F04C 29/02–08; F04C 2240/40; F25B 1/10; F25B 31/004; F04B 25/00; F04B 39/02
(Continued)

(56) References Cited

U.S. PATENT DOCUMENTS 4,179,248 A * 12/1979 Shaw ..... F04C 29/02 417/427
5,236,311 A * 8/1993 Lindstrom ..... F04B 25/00 417/254
(Continued)

FOREIGN PATENT DOCUMENTS

DE 10 2013 014 543 A1 3/2015
EP 2 172 653 A1 4/2010
(Continued)

OTHER PUBLICATIONS

Emerson Climate Technologies, Suction Line Accumulators, Mar. 2014.*
(Continued)

*Primary Examiner* — Alexander B Comley
(74) *Attorney, Agent, or Firm* — Global IP Counselors, LLP

(57) ABSTRACT

A multistage compression system uses refrigerant and oil. The multistage compression system includes a low-stage compressor that compresses the refrigerant, a high-stage compressor that further compresses the refrigerant compressed by the low-stage compressor, an oil return pipe that returns the oil discharged by the high-stage compressor to the low-stage compressor, and an oil discharge pipe that
(Continued)

discharges the oil in the low-stage compressor. The low-stage compressor includes a compression part that compresses the refrigerant, a motor that drives the compression part, and a container that houses the compression part and the motor. The container forms a high-pressure space storing compressed refrigerant. Inside of the oil return pipe and inside of the oil discharge pipe are connected to the high-pressure space.

11 Claims, 5 Drawing Sheets

(58) Field of Classification Search
USPC ..... 417/205, 410.3
See application file for complete search history.

(56) References Cited

U.S. PATENT DOCUMENTS

| | | | | |
|---|---|---|---|---|
| 6,446,462 | B1 * | 9/2002 | Kiyokawa | F25B 31/002 62/469 |
| 2007/0245768 | A1 | 10/2007 | Sakae et al. | |
| 2008/0152524 | A1 * | 6/2008 | Kishi | F04C 18/16 418/1 |
| 2011/0036110 | A1 | 2/2011 | Fujimoto et al. | |

FOREIGN PATENT DOCUMENTS

| | | | | |
|---|---|---|---|---|
| EP | 2 863 151 | A2 | | 4/2015 |
| EP | 3 136 020 | A1 | | 3/2017 |
| JP | 4-371759 | A | | 12/1992 |
| JP | 7-260263 | A | | 10/1995 |
| JP | 7-301465 | A | | 11/1995 |
| JP | 2001-272122 | A | | 10/2001 |
| JP | 2004-285854 | A | | 10/2004 |
| JP | 2006-258002 | A | | 9/2006 |
| JP | 2006-348951 | A | | 12/2006 |
| JP | 2007-9922 | A | | 1/2007 |
| JP | 2007-93017 | A | | 4/2007 |
| JP | 2008-175066 | A | | 7/2008 |
| JP | 2008175066 | A | * | 7/2008 |
| JP | 2008-261227 | A | | 10/2008 |
| JP | 2008261227 | A | * | 10/2008 |
| JP | 2009-79820 | A | | 4/2009 |
| JP | 2009079820 | A | * | 4/2009 |
| JP | 2009-133584 | A | | 6/2009 |
| JP | 2011-202817 | A | | 10/2011 |
| JP | 2011-214758 | A | | 10/2011 |
| JP | 2012-180963 | A | | 9/2012 |
| JP | 2013-181736 | A | | 9/2013 |
| JP | 2015-34536 | A | | 2/2015 |
| JP | 2015-78804 | A | | 4/2015 |
| JP | 2017-44420 | A | | 3/2017 |
| JP | 2018-31263 | A | | 3/2018 |

OTHER PUBLICATIONS

Mattei, Which Are Better: Rotary Vane or Reciprocating Compressors?, Aug. 2018.*
International Preliminary Report of corresponding PCT Application No. PCT/JP2019/037670 dated Apr. 8, 2021.
International Search Report of corresponding PCT Application No. PCT/JP2019/037670 dated Dec. 10, 2019.
European Search Report of corresponding EP Application No. 19 86 6259.5 dated Sep. 14, 2021.
European Search Report of corresponding EP Application No. 19 86 6258.7 dated Oct. 21, 2021.
European Search Report of corresponding EP Application No. 19 86 7267 dated Oct. 5, 2021.
European Search Report of corresponding EP Application No. 19 86 4032.8 dated Sep. 29, 2021.

* cited by examiner

MULTISTAGE COMPRESSION SYSTEM

CROSS-REFERENCE TO RELATED APPLICATIONS

This U.S. National stage application claims priority under 35 U.S.C. § 119(a) to Japanese Patent Application No. 2018-185073, filed in Japan on Sep. 28, 2018, the entire contents of which are hereby incorporated herein by reference.

BACKGROUND

Field of the Invention

A multistage compression system using refrigerant and oil.

Background Information

In a refrigeration apparatus, a multistage compression mechanism using a plurality of compressors is recommended and used depending on working refrigerant. In the multistage compression mechanism using the plurality of compressors, it is important to control refrigerator oil in an appropriate amount in the plurality of compressors. That is, the oil is to be controlled not to be extremely unevenly distributed in one compressor.

In JP 2008-261227 A, a low-stage oil drain passage of a low-stage compressor and an oil return passage for returning oil discharged in a high-stage compressor to a suction pipe of the lower-stage compressor are provided in order to keep an oil level of the low-stage and high-stage compressors constant.

SUMMARY

In JP 2008-261227 A, the oil discharged by the high-stage compressor is returned to a suction side of an accumulator before the low-stage compressor. A hole for returning the oil provided in the suction pipe in the accumulator generally has a small hole diameter. Therefore, connecting an oil return pipe to the suction side of the accumulator will not make it easy to quickly increase an amount of oil in the low-stage compressor.

A multistage compression system according to a first aspect uses refrigerant and oil. The multistage compression system has a low-stage compressor, a high-stage compressor, an oil return pipe, and an oil discharge pipe. The low-stage compressor compresses the refrigerant. The high-stage compressor further compresses the refrigerant compressed by the low-stage compressor. The oil return pipe returns the oil discharged by the high-stage compressor or the oil in the high-stage compressor to the low-stage compressor. The oil discharge pipe discharges the oil in the low-stage compressor. Further, the low-stage compressor has a compression part, a motor, and a container. The compression part compresses the refrigerant. The motor drives the compression part. The container houses the compression part and the motor. The oil return pipe and the oil discharge pipe are connected to the container.

In the multistage compression system according to the first aspect, because the oil return pipe is connected to the container, oil return quickly responds and increases an amount of oil in the low-stage compressor easily. Further, because the oil discharge pipe is also connected to the container, more rapid control of the amount of oil can be achieved.

A multistage compression system according to a second aspect is the system according to the first aspect, in which the motor is disposed above the compression part.

A multistage compression system according to a third aspect is the system according to the first or second aspect, in which the oil return pipe and the oil discharge pipe are connected to the container above the compression part and below the motor. Specifically, the compression part is a compression chamber. When the low-stage compressor has two or more compression chambers having different heights, the compression chamber referred to here means a lowest compression chamber.

In the multistage compression system according to the third aspect, the oil return pipe is connected to a position above the compression part of the container and below the motor, and thus the oil can be supplied more quickly to an oil reservoir of the low-stage compressor. Further, because the oil discharge pipe is connected to a position above the compression part of the container and below the motor, excess oil of the low-stage compressor can be discharged from the low-stage compressor without excess or deficiency.

A multistage compression system according to a fourth aspect is the system according to any of the first to third aspects, in which a connecting portion of the oil return pipe to the container is higher than a connecting portion of the oil discharge pipe to the container.

In the multistage compression system according to the fourth aspect, an oil level of the oil reservoir of the low-stage compressor is appropriately controlled.

A multistage compression system according to a fifth aspect is the system according to any of the first to third aspects, in which a connecting portion of the oil return pipe to the container is as high as a connecting portion of the oil discharge pipe to the container.

In the multistage compression system according to the fifth aspect, the oil level of the oil reservoir of the low-stage compressor is suppressed so as not to rise too high, and the amount of the oil in the low-stage compressor is appropriately controlled.

A multistage compression system according to a sixth aspect is the system according to any of the first to fifth aspects, in which, in a top view, the connecting portion of the oil discharge pipe to the container is separated from the connecting portion of the oil return pipe to the container by 90° or more in a rotation direction of the motor.

In the multistage compression system according to the sixth aspect, due to a positional relationship between the oil discharge pipe and the oil return pipe, the oil introduced into the container of the low-stage compressor by the oil return pipe to be discharged outside the container directly by the oil discharge pipe is reduced, thereby appropriately equalizing the oil in the low-stage compressor.

A multistage compression system according to a seventh aspect is the system according to the sixth aspect, in which the connecting portion of the oil discharge pipe to the container is separated from the connecting portion of the oil return pipe to the container by 180° or more in the rotation direction of the motor.

In the multistage compression system according to the seventh aspect, the oil introduced into the container of the low-stage compressor by the oil return pipe to be discharged outside the container directly by the oil discharge pipe is reduced.

A multistage compression system according to an eighth aspect is the system according to any of the first to seventh aspects, in which the compression part is provided with a compression chamber. In the compression chamber, the refrigerant is introduced and compressed. The compression part has a muffler. The muffler is provided with a discharge hole. The discharge hole discharges the refrigerant compressed in the compression chamber. In a top view, the connecting portion of the oil discharge pipe to the container is a position opposite to the discharge hole of the muffler with respect to a rotation center of the motor. Here, the opposite position refers to a range of 180° other than a total of 180°, which is 90° to left and right of the rotation center from the connecting portion of the oil discharge pipe.

In the multistage compression system according to the eighth aspect, the connecting portion of the oil discharge pipe to the container is separated from positions of the discharge hole of the muffler. This can reduce the refrigerant discharged from the discharge hole of the muffler to be discharged from the low-stage compressor directly by the oil discharge pipe.

A multistage compression system according to a ninth aspect is the system according to any of the first to eighth aspects, in which the oil discharge pipe has a diameter equivalent to a diameter of the oil return pipe.

In the multistage compression system according to the ninth aspect, the oil discharge pipe has the diameter equivalent to the diameter of the oil return pipe, which makes it easy to adjust an oil return amount and an oil discharge amount equally and to equalize the oil in the low-stage compressor.

A multistage compression system according to a tenth aspect is the system according to any of the first to ninth aspects, in which the refrigerant is refrigerant mainly including carbon dioxide, and the oil is oil insoluble with carbon dioxide.

In the multistage compression system according to the tenth aspect, the refrigerant and the oil are insoluble with each other, thereby making it easy to separate the refrigerant from the oil, introduce mainly the oil into the low-stage compressor, and discharge mainly the refrigerant from the low-stage compressor.

DETAILED DESCRIPTION OF EMBODIMENT(S)

First Embodiment

(1) Refrigerant Circuit of Refrigeration Apparatus 1

(1-1) Entire Refrigerant Circuit of Refrigeration Apparatus 1

Figure 1:
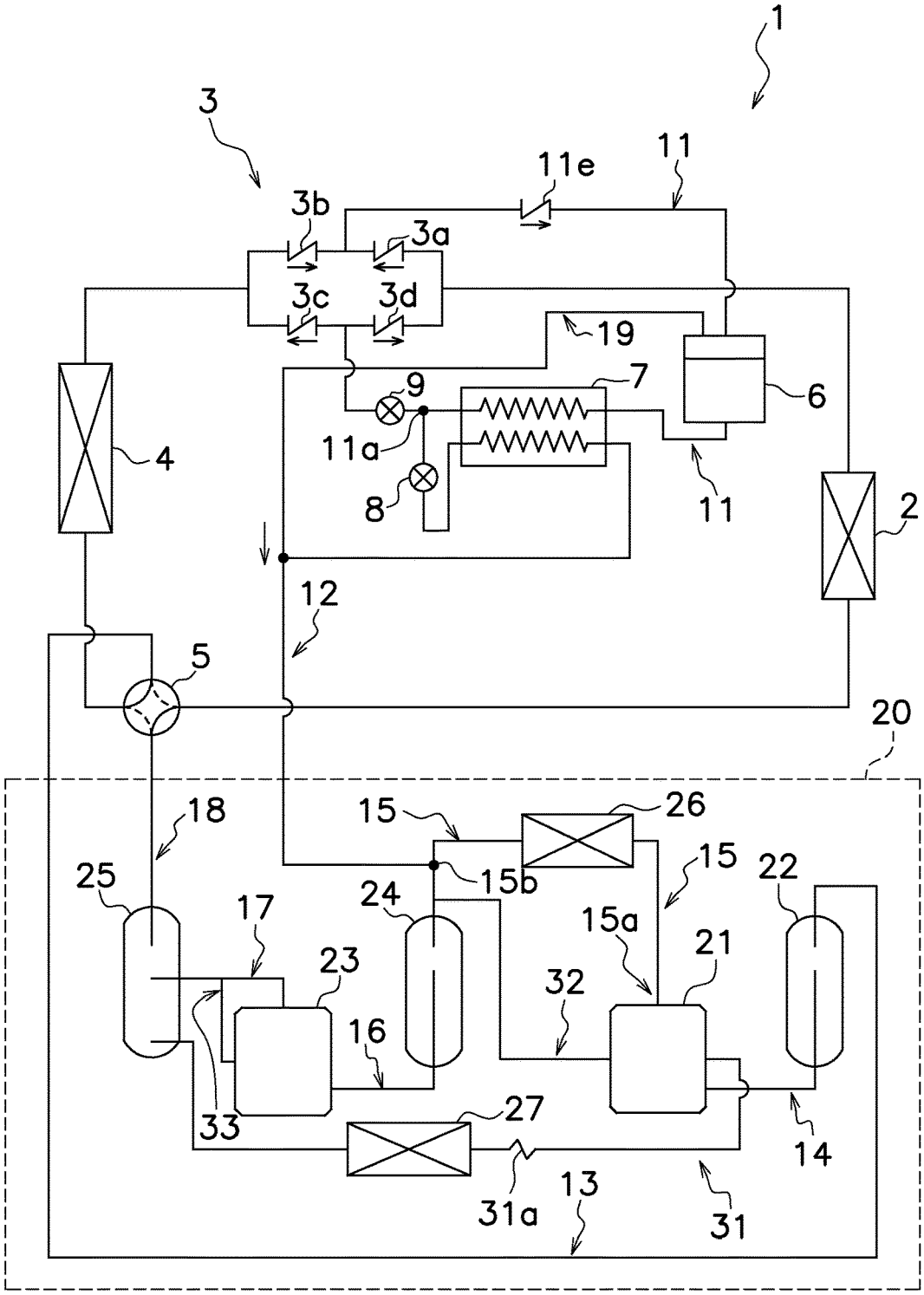
FIG. 1 is a refrigerant circuit diagram of a refrigeration apparatus 1 according to a first embodiment.

FIG. 1 shows a refrigerant circuit configuration of a refrigeration apparatus 1 according to a first embodiment. The refrigeration apparatus 1 according to the present embodiment is an apparatus that performs a two-stage compression refrigeration cycle using carbon dioxide as refrigerant that operates in a supercritical region. The refrigeration apparatus 1 according to the present embodiment can be used for an air conditioner for heating and cooling, an air conditioner dedicated for cooling, a water cooler and heater, a refrigerator, a refrigeration storage apparatus, and the like.

The refrigerant circuit of the refrigeration apparatus 1 according to the present embodiment has a multistage compression system 20, a four-way switching valve 5, a heat source side heat exchanger 2, a bridge circuit 3, expansion mechanisms 8 and 9, a use side heat exchanger 4, and an economizer heat exchanger 7.

The multistage compression system 20 compresses the refrigerant. Gas refrigerant is introduced into a first accumulator 22 at an inlet of a low-stage compressor 21 via the four-way switching valve 5 and a refrigerant pipe 13. The refrigerant is compressed by the low-stage compressor 21 and a high-stage compressor 23, and reaches the four-way switching valve 5 via a pipe 18.

The four-way switching valve 5 switches directions in which the refrigerant from the multistage compression system 20 flows to the heat source side heat exchanger 2 or to the use side heat exchanger 4. For example, when the refrigeration apparatus 1 is an air conditioner and is performing a cooling operation, the refrigerant flows from the four-way switching valve 5 to the heat source side heat exchanger 2 (condenser). The refrigerant flowing through the heat source side heat exchanger 2 (condenser) reaches a receiver 6 via a check valve 3*a* of the bridge circuit 3, a pipe 11, and a check valve 11*e*. The liquid refrigerant continues to flow from the receiver 6 through the pipe 11, is decompressed by the expansion mechanism 9, and flows to the use side heat exchanger 4 (evaporator) via a check valve 3*c* of the bridge circuit 3. The refrigerant heated by the use side heat exchanger 4 (evaporator) passes through the four-way switching valve 5, and is compressed again by the multistage compression system 20. On the other hand, during a heating operation, the refrigerant flows from the four-way switching valve 5 to the use side heat exchanger 4 (condenser), a check valve 3*b* of the bridge circuit 3, the pipe 11, the receiver 6, the expansion mechanism 9, a check valve 3*d* of the bridge circuit 3, the use side heat exchanger 4 (evaporator), and the four-way switching valve 5 in this order.

The economizer heat exchanger 7 is, in a middle of the refrigerant pipe 11, disposed between the receiver 6 and the expansion mechanism 9. At a branch 11*a* of the pipe 11, a part of the refrigerant branches and is decompressed to an intermediate pressure at the expansion mechanism 8. The intermediate-pressure refrigerant is heated by the high-pressure refrigerant flowing through the pipe 11 in the economizer heat exchanger 7 and injected into a merging part 15*b* of an intermediate pressure of the multistage compression system 20 via an intermediate injection pipe 12. Further, a gas component of the refrigerant from the receiver 6 merges into the intermediate injection pipe 12 via the pipe 19.

(1-2) Flow of Refrigerant and Oil in Multistage Compression System 20

As shown in FIG. 1, the multistage compression system 20 according to the present embodiment includes the first accumulator 22, the low-stage compressor 21, an intercooler 26, a second accumulator 24, the high-stage compressor 23, an oil separator 25, an oil cooler 27, and a decompressor 31*a*.

In the present embodiment, the refrigerant compressed by the low-stage compressor 21 is further compressed by the high-stage compressor 23. The compressors 21 and 23 are provided with the accumulator 22 and the accumulator 24, respectively. The accumulators 22 and 24 play a role of storing the refrigerant before entering the compressor once and preventing the liquid refrigerant from being sucked into the compressor.

Next, a flow of the refrigerant and the oil in the multistage compression system 20 according to the present embodiment will be described with reference to FIG. 1.

In the present embodiment, the low-pressure gas refrigerant heated by the evaporator (use side heat exchanger 4 or heat source side heat exchanger 2) flows to the first accumulator 22 via the refrigerant pipe 13. The gas refrigerant of the first accumulator 22 flows to the low-stage compressor 21 via a suction pipe 14. The refrigerant compressed by the low-stage compressor 21 is discharged from a discharge pipe 15*a*, flows through an intermediate pressure refrigerant pipe 15, and reaches the second accumulator 24.

The intercooler 26 is disposed in a middle of the intermediate pressure refrigerant pipe 15. The intercooler 26 is a heat exchanger that cools the intermediate-pressure refrigerant with, for example, outdoor air. The intercooler 26 may be disposed adjacent to the heat source side heat exchanger 2 and exchange heat with air by a common fan. The intercooler 26 enhances efficiency of the refrigeration apparatus 1 by cooling the intermediate-pressure refrigerant.

Further, the intermediate-pressure refrigerant is injected into the merging part 15*b* of the intermediate pressure refrigerant pipe 15 from the intermediate injection pipe 12. In the present embodiment, the merging part 15*b* of the intermediate injection pipe 12 with the pipe 15 is disposed downstream of the intercooler 26. A temperature of the refrigerant injected by intermediate injection is lower than a temperature of the refrigerant flowing through the pipe 15. Thus, the intermediate injection lowers the temperature of the refrigerant flowing through the pipe 15 and improves the efficiency of the refrigeration apparatus 1.

The multistage compression system 20 according to the present embodiment further includes an oil discharge pipe 32 that discharges excess oil from the low-stage compressor 21. The oil discharge pipe 32 connects the low-stage compressor 21 and the pipe 15 of an intermediate pressure. The oil discharge pipe 32 discharges not only the excess oil accumulated in an oil reservoir of the low-stage compressor 21 but also excess refrigerant accumulated in the oil reservoir. A connection part of the oil discharge pipe 32 with the intermediate pressure refrigerant pipe 15 is a part downstream of the intercooler 26 and the merging part 15*b* of the intermediate injection pipe.

The refrigerant sent to the second accumulator 24 by the pipe 15 is introduced into the high-stage compressor 23 from a suction pipe 16. The refrigerant is compressed in the high-stage compressor 23 to a high pressure, and is discharged to a discharge pipe 17.

The refrigerant discharged to the discharge pipe 17 flows to the oil separator 25. The oil separator 25 separates the refrigerant from the oil. The separated oil is returned to the low-stage compressor 21 via an oil return pipe 31.

The multistage compression system 20 according to the present embodiment further includes an oil discharge pipe 33 that discharges excess oil from the high-stage compressor 23. The oil discharge pipe 33 connects the high-stage compressor 23 and the discharge pipe 17 of the high-stage compressor 23.

The decompressor 31*a* is disposed in a middle of the oil return pipe 31. The decompressor 31*a* is for decompressing the high-pressure oil discharged from the oil separator 25. Specifically, for example, a capillary tube is used for the decompressor 31*a*.

The oil cooler 27 is disposed in the middle of the oil return pipe 31. The oil cooler 27 is a heat exchanger that cools the oil flowing through the oil return pipe 31, for example, with the outdoor air. The oil cooler 27 is for cooling the high-temperature oil discharged from the oil separator 25. The oil cooler 27 may be disposed, for example, near the heat source side heat exchanger 2 and may exchange heat with air by a common fan.

The oil (refrigerator oil) according to the present embodiment is not limited as long as the oil is refrigerator oil used as $CO_2$ refrigerant, but oil insoluble with the $CO_2$ refrigerant is particularly suitable. Examples of refrigerator oil include polyalkylene glycols (PAG) and polyester esters (POE).

The refrigeration apparatus 1 according to the present embodiment performs two-stage compression with two compressors. Two or more stages of compression may be performed using three or more compressors. Further, three or more stages of compression may be performed.

(2) Configuration of Compressor and Pipe and Device Connected to Compressor

Both the low-stage compressor 21 and the high-stage compressor 23 according to the present embodiment are two-cylinder and oscillating rotary compressors. The compressors 21 and 23, which have almost the same configuration, will be described in detail here using the low-stage compressor 21.

Figure 2:
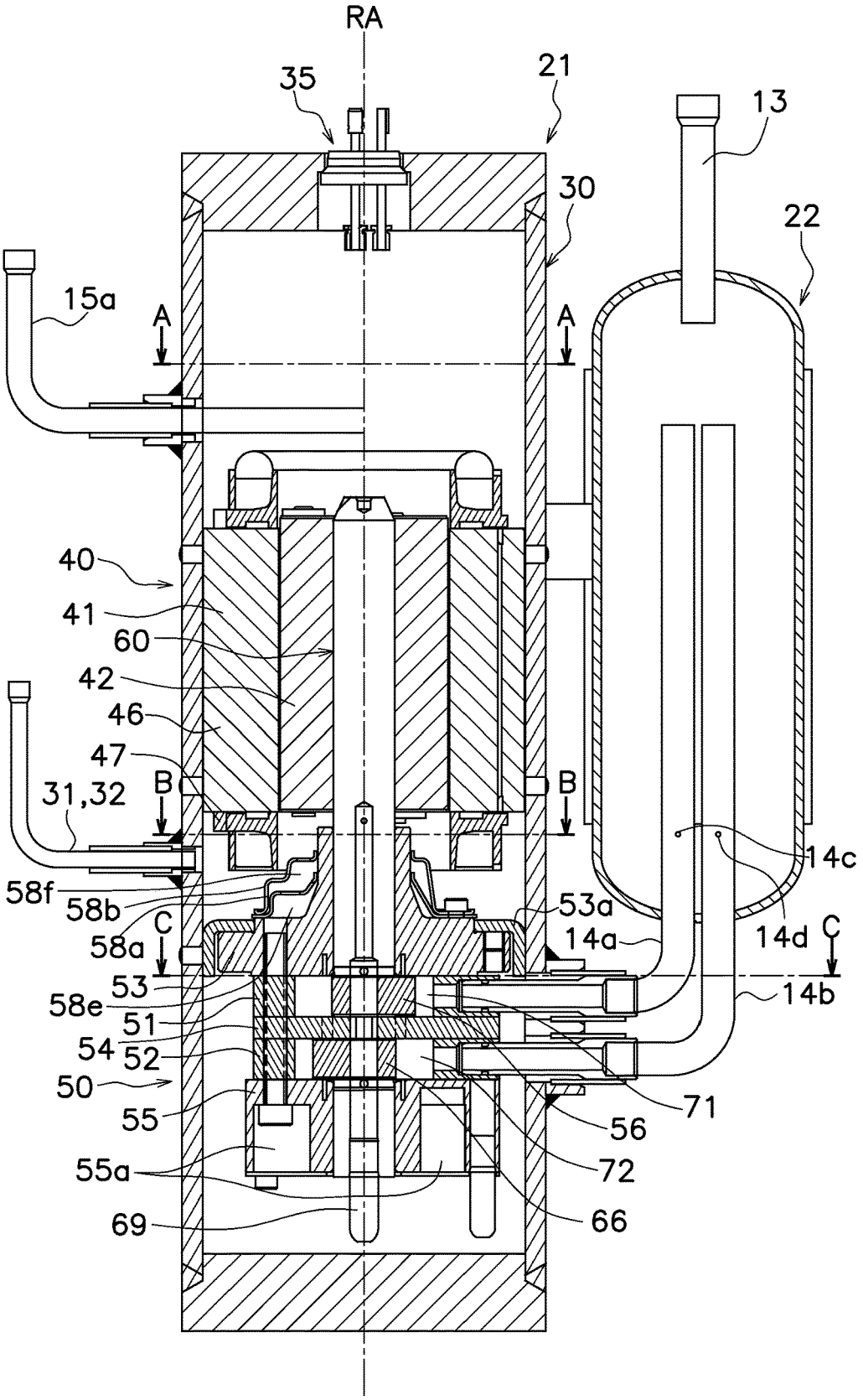
FIG. 2 is a vertical sectional view of a low-stage compressor 21 according to the first embodiment.
Figure 3:
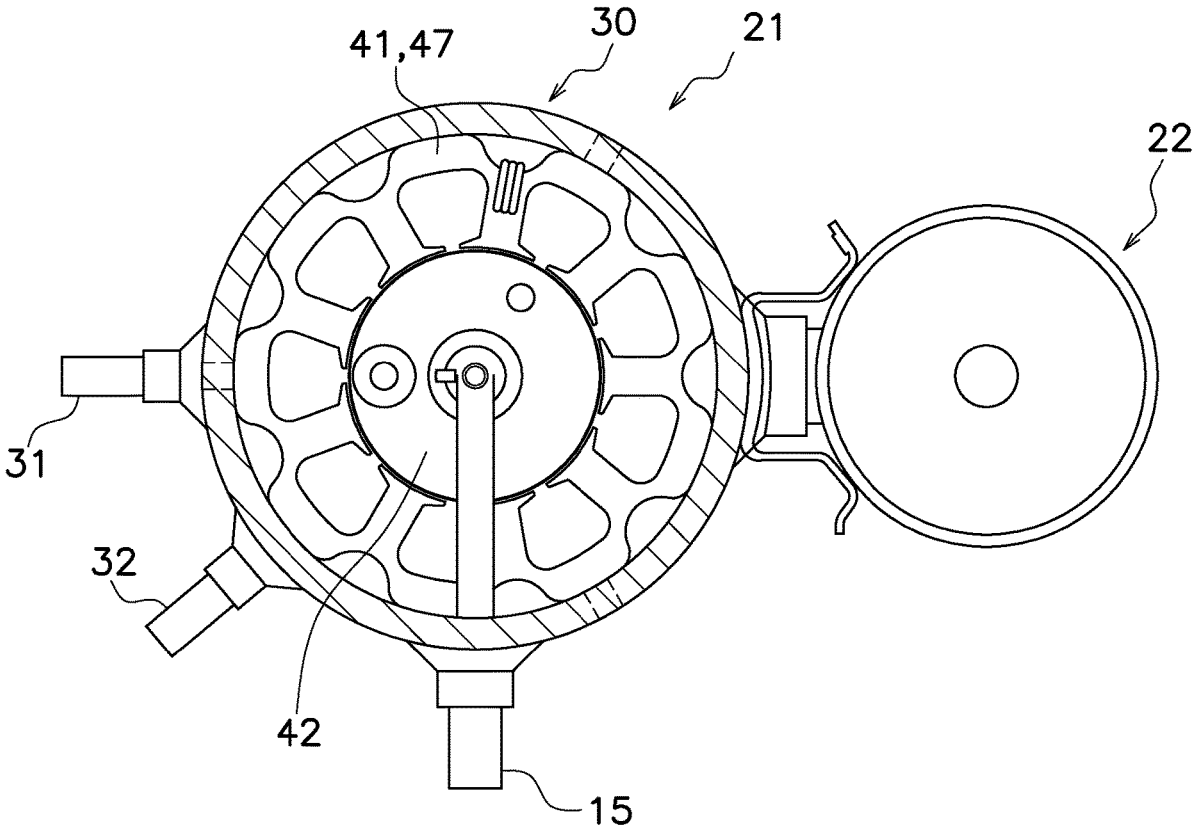
FIG. 3 is a sectional view taken along line A-A of the low-stage compressor 21 according to the first embodiment.
Figure 4:
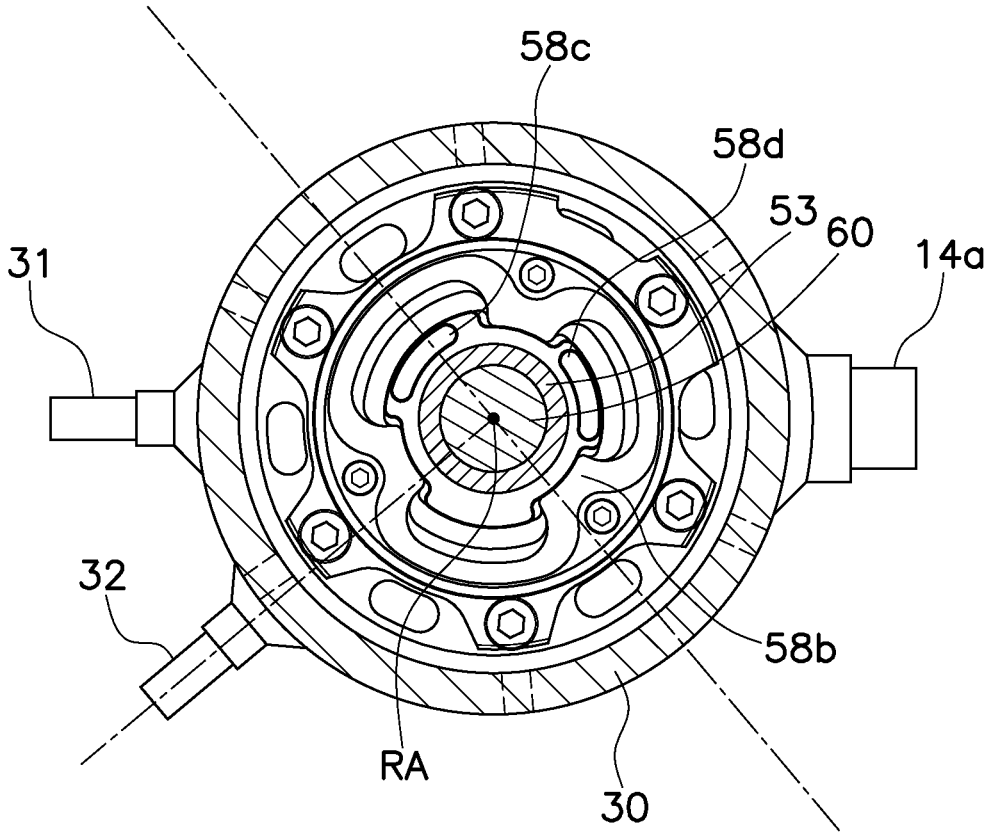
FIG. 4 is a sectional view taken along line B-B of the low-stage compressor 21 according to the first embodiment.
Figure 5:
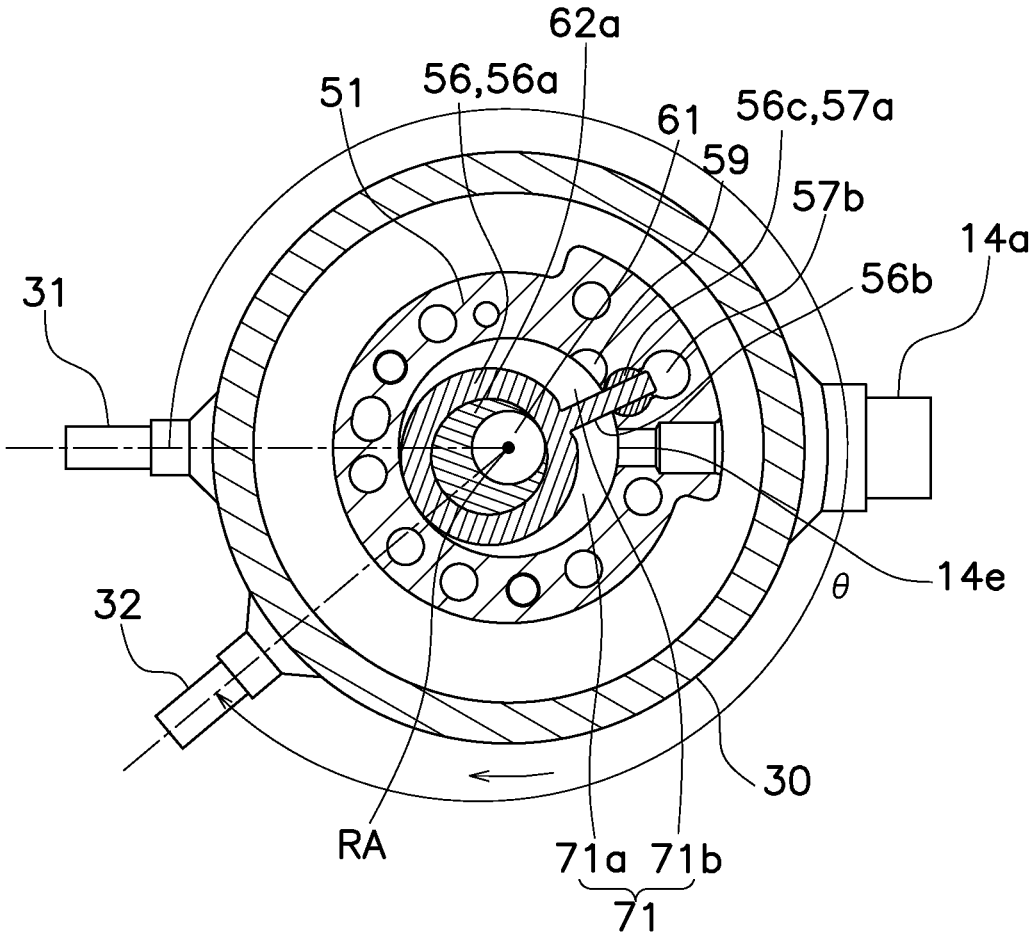
FIG. 5 is a sectional view taken along line C-C of the low-stage compressor 21 according to the first embodiment.

FIG. 2 is a vertical sectional view of the low-stage compressor 21, and FIGS. 3 to 5 are horizontal sectional views taken along lines A-A to C-C in FIG. 2, respectively. However, in the B-B sectional view in FIG. 4, a motor 40 is not shown.

The low-stage compressor 21 has a container 30, a compression part 50, the motor 40, a crankshaft 60, and a terminal 35.

(2-1) Container 30

The container 30 has a substantially cylindrical shape with an axis RA of the motor 40 as a center axis. The inside of the container is kept airtight, and an intermediate pressure is maintained in the low-stage compressor 21 and a high pressure is maintained in the high-stage compressor 23 during an operation. A lower part of the inside of the container 30 is the oil reservoir (not shown) for storing oil (lubricating oil).

The container 30 houses the motor 40, the crankshaft 60, and the compression part 50 inside. The terminal 35 is located above the container 30. Further, the container 30 is connected to suction pipes 14*a* and 14*b* and the discharge pipe 15*a* of the refrigerant, the oil return pipe 31, and the oil discharge pipe 32. The discharge pipe 15*a* is connected to the intermediate pressure refrigerant pipe 15.

(2-2) Motor 40

The motor 40 is a brushless DC motor. The motor 40 generates power to rotate the crankshaft 60 around the axis RA. The motor 40 is disposed in a space inside the container 30, below an upper space, and above the compression part 50. The motor 40 has a stator 41 and a rotor 42. The stator 41 is fixed to an inner wall of the container 30. The rotor 42 rotates by magnetically interacting with the stator 41.

The stator 41 has a stator core 46 and insulators 47. The stator core 46 is made of steel. The insulator 47 is made of resin. The insulators 47 are disposed above and below the stator core 46, and wires are wound around the insulators 47.

(2-3) Crankshaft 60

The crankshaft 60 transmits power of the motor 40 to the compression part 50. The crankshaft 60 has a main shaft 61, a first eccentric part 62*a*, and a second eccentric part 62*b*.

The main shaft 61 is a part concentric with the axis RA. The main shaft 61 is fixed to the rotor 42.

The first eccentric part 62*a* and the second eccentric part 62*b* are eccentric with respect to the axis RA. A shape of the first eccentric part 62*a* and a shape of the second eccentric part 62*b* are symmetrical with respect to the axis RA.

An oil tube 69 is provided at a lower end of the crankshaft 60. The oil tube 69 pumps oil (lubricating oil) from the oil reservoir. The pumped lubricating oil rises in an oil passage inside the crankshaft 60 and is supplied to a sliding part of the compression part 50.

(2-4) Compression Part 50

The compression part 50 is a two-cylinder compression mechanism. The compression part 50 has a first cylinder 51, a first piston 56, a second cylinder 52, a second piston 66, a front head 53, a middle plate 54, a rear head 55, and front mufflers 58*a* and 58*b*.

A first compression chamber 71 and a second compression chamber 72 are formed in the compression part 50. The first and second compression chambers are spaces to which the refrigerant is supplied and compressed.

(2-4-1) First Compression Chamber 71 and Flow of Refrigerant Compressed in First Compression Chamber 71

As shown in FIG. 2 or 5, the first compression chamber 71 is a space surrounded by the first cylinder 51, the first piston 56, the front head 53, and the middle plate 54.

As shown in FIG. 5, the first cylinder 51 is provided with a suction hole 14*e*, a discharge concave portion 59, a bush housing hole 57*a*, and a blade moving hole 57*b*. The first cylinder 51 houses the main shaft 61 and the first eccentric part 62*a* of the crankshaft 60 and the first piston 56. The suction hole 14*e* communicates the first compression chamber 71 with the inside of the suction pipe 14*a*. A pair of bushes 56*c* is housed in the bush housing hole 57*a*.

The first piston 56 has an annular part 56*a* and a blade 56*b*. The first piston 56 is a swing piston. The first eccentric part 62*a* of the crankshaft 60 is fitted into the annular part 56*a*. The blade 56*b* is sandwiched between the pair of bushes 56*c*. The first piston 56 divides the first compression chamber 71 into two. One of the divided chambers is a low pressure chamber 71*a* that communicates with the suction hole 14*e*. The other divided chamber is a high pressure chamber 71*b* that communicates with the discharge concave portion 59. In FIG. 5, the annular part 56*a* revolves clockwise, a volume of the high pressure chamber 71*b* becomes small, and the refrigerant in the high pressure chamber 71*b* is compressed. When the annular part 56*a* revolves, a tip of the blade 56*b* reciprocates between the blade moving hole 57*b* and the bush housing hole 57*a*.

As shown in FIG. 2, the front head 53 is fixed to an inner side of the container 30 by an annular member 53*a*.

The front mufflers 58*a* and 58*b* are fixed to the front head 53. The front mufflers reduce noise when the refrigerant is discharged.

The refrigerant compressed in the first compression chamber 71 is discharged to a first front muffler space 58*e* between the front muffler 58*a* and the front head 53 via the discharge concave portion 59. After further moving to a second front muffler space 58*f* between the two front mufflers 58*a* and 58*b*, the refrigerant is blown out to a space below the motor 40 from discharge holes 58*c* and 58*d* (see FIG. 4) provided in the front muffler 58*b*.

The refrigerant that has been compressed and blown out from the discharge holes 58*c* and 58*d* of the front muffler 58*a* moves to an upper space of the container 30 through a gap of the motor 40, is blown out from the discharge pipe 15*a*, and proceeds to the high-stage compressor 23.

(2-4-2) Second Compression Chamber 72 and Flow of Refrigerant Compressed in Second Compression Chamber 72

The second compression chamber 72 is a space surrounded by the second cylinder 52, the second piston 66, the rear head 55, and the middle plate 54.

The flow of the refrigerant compressed in the second compression chamber 72, which is almost similar to the flow of the refrigerant compressed in the first compression chamber 71, will not be described in detail. However, the refrigerant compressed in the second compression chamber 72 is different in that the refrigerant is once sent to a rear muffler space 55*a* provided in the rear head 55, and then further sent to the front muffler spaces 58*e* and 58*f* by the front mufflers 58*a* and 58*b*.

(2-5) Connecting Portion of Compressor 21 with Oil Return Pipe 31 and Oil Discharge Pipe 32

As shown in FIG. 2, the oil return pipe 31 is connected to the container 30 such that an internal flow path communicates with the space above the compression part 50 below the motor 40. The oil blown out of the oil return pipe 31 into the container 30 collides with the insulator 47 of the motor 40 and then falls on the front muffler 58*b* and the annular member 53*a* fixing the front head 53, and further, merges into the oil reservoir at the lower part of the inside of the container 30.

The oil return pipe 31 is preferably connected to a space above the second compression chamber 72. If the oil return pipe 31 is connected to a space below the second compression chamber 72, there is a high possibility that an oil level will be below an oil level of the oil reservoir, thereby causing foaming which is not preferable.

Further, the oil return pipe 31 may be connected to above the container 30. For example, the oil return pipe 31 may be connected to a core cut part of the stator 41 of the motor 40. However, the oil return pipe 31 is preferably connected to a lower part as close as possible to the oil reservoir, allowing the oil to be supplied to a sliding part (near the compression chambers 71 and 72) more quickly.

An inner diameter of the oil return pipe 31 is, for example, 10 mm or more and 12 mm or less.

As shown in FIG. 2, the oil discharge pipe 32 is connected to the container 30 such that the internal flow path communicates with the space above the compression part 50 below the motor 40.

If the connecting portion of the oil discharge pipe 32 to the container 30 is below the compression chamber 72, the oil may be lost excessively from the oil reservoir. If the connecting portion is above the motor 40, a difference between the oil discharge pipe 32 and the discharge pipe 15*a* will be small, and meaning of providing the oil discharge pipe 32 will be lost.

Further, in the present embodiment, as shown in FIG. 2, an attachment height position of the oil discharge pipe 32 with the container 30 is equivalent to an attachment height position of the oil return pipe 31 with the container 30. This facilitates adjustment of the oil level of the oil reservoir.

Further, as shown in FIG. 4, the attachment position of the oil discharge pipe 32 to the container 30 having a flat shape is a position opposite to the discharge holes 58*c* and 58*d* of the front muffler 58*b* with respect to the axis RA of the motor 40. Here, the opposite position refers to a range of 180° other than a total of 180°, which is 90° to left and right of the axis RA from the connecting portion of the oil discharge pipe 32. Here, this means that half or more of an area of the discharge holes 58*c* and 58*d* is on the opposite side although a part of the discharge hole 58*c* is not in the opposite position in FIG. 4.

In the present embodiment, the connecting portion of the oil discharge pipe 32 to the container 30 is separated from positions of the discharge holes 58*c* and 58*d* of the front muffler 58*b*. This can reduce the refrigerant discharged from the discharge holes 58*c* and 58*d* of the front muffler 58*b* to be discharged from the low-stage compressor 21 directly by the oil discharge pipe 32.

An inner diameter of the oil discharge pipe 32 is equivalent to the inner diameter of the oil return pipe 31. The oil discharge pipe 32 having a smaller inner diameter than the discharge pipe 15*a* is used. Specifically, the inner diameter of the oil discharge pipe 32 is, for example, 10 mm or more and 12 mm or less.

Further, as shown in FIG. 5, in a planar positional relationship between the oil discharge pipe 32 and the oil return pipe 31, the connecting portion of the oil discharge pipe 32 to the container 30 is separated from the connecting portion of the oil return pipe 31 to the container 30 by 90° or more in a rotation direction of the motor 40 (a direction of an arrow in FIG. 5). The connecting portion is preferably a position separated by 180° or more. In the present embodiment, this angle is represented by θ. θ is 270° or more. Also, θ is to be 330° or less.

In the present embodiment, the positions of the oil discharge pipe 32 and the oil return pipe 31 are sufficiently separated, and this reduces the oil introduced into the container 30 of the low-stage compressor 21 by the oil return pipe 31 to be discharged outside the container 30 directly by the oil discharge pipe 32, thereby easily equalizing the oil in the low-stage compressor 21.

(2-6) Accumulator 22

In the multistage compression system 20 according to the present embodiment, the first accumulator 22 is disposed upstream of the low-stage compressor 21 and the second accumulator 24 is disposed upstream of the high-stage compressor 23. The accumulators 22 and 24 once store the flowing refrigerant, prevent the liquid refrigerant from flowing to the compressor, and prevent liquid compression of the compressor. Configurations of the first accumulator 22 and the second accumulator 24 are almost the same, and thus the first accumulator 22 will be described with reference to FIG. 2.

The low-pressure gas refrigerant heated by the evaporator flows through the refrigerant pipe 13 via the four-way switching valve 5 and is introduced into the accumulator 22. The gas refrigerant is introduced into the first and second compression chambers 71 and 72 from the suction pipes 14*a* and 14*b* of the compressor 21. The liquid refrigerant and the oil accumulate at a lower part inside the accumulator. Small holes 14*c* and 14*d* are formed in the suction pipes 14*a* and 14*b* at a lower part inside the accumulator. Diameters of the holes 14*c* and 14*d* are, for example, from 1 mm to 2 mm. The oil, together with the liquid refrigerant, merges with the gas refrigerant little by little through the holes 14*c* and 14*d* and is sent to the compression chamber.

(3) Method of Manufacturing Multistage Compression System 20

In the multistage compression system 20 according to the present embodiment, a method of assembling the low-stage compressor 21 and its surroundings, which is peculiar to the present embodiment, will be briefly described.

Conventionally, a shrink fitting method is used for incorporating a motor into a compressor. However, in the present embodiment, it is necessary to make a hole in the container and weld a seat to the container in advance in order to connect the oil return pipe and the like to the container. When a seat is formed on the container, the container is distorted from a perfect circle, thereby making it difficult to incorporate the motor by the shrink fitting method. Thus, in the present embodiment, the assembly is performed by using a welding method as follows.

First, an upper lid of a cylindrical part of the container is combined and welded.

Next, a seat for connecting the oil return pipe 31 and the like to the container is formed in the container.

Next, the motor 40 is inserted from under the container and fixed to the container by the welding method. Here, as the welding method, a tag (TAG) welding method is used. Here, the tag welding method refers to a method of performing spot welding at several points (for tag welding of the container and the motor, see Japanese Patent No. 5375534, for example).

The compression part 50 is inserted into the container and fixed to the container. A fixing method is the tag welding as in the case of the motor.

A pipe such as the oil return pipe 31 is fixed to the seat formed on the container.

In this way, by using the tag welding, it is possible to fix the motor or the like to the container relatively easily even if roundness of the container is distorted due to formation of the seat of the oil return pipe 31 and the like.

(4) Characteristics

(4-1)

The multistage compression system 20 according to the present embodiment is a system having the low-stage compressor 21 and the high-stage compressor 23. This system is characterized by having the oil return pipe 31 and the oil discharge pipe 32 connected to the container 30 of the low-stage compressor 21. The oil return pipe 31 returns the oil discharged from the high-stage compressor 23 to the low-stage compressor 21. The oil discharge pipe 32 discharges the excess oil from the low-stage compressor 21.

In the multistage compression system 20 according to the present embodiment, the oil return pipe 31 is directly connected to the container 30 of the low-stage compressor 21, and thus the oil return pipe 31 responds quickly. That is, the oil can be supplied to the container faster than when the oil return pipe 31 is connected to the suction pipe (refrigerant pipe 13) of the first accumulator 22 as conventionally. Further, the oil discharge pipe 32 is also connected to the same container 30, and thus the excess oil can be quickly discharged from the low-stage compressor 21. That is, the oil return pipe 31 that responds well and the oil discharge pipe 32 are both connected to the container 30, and thus an amount of oil in the low-stage compressor 21 can be controlled quickly.

(4-2)

In the multistage compression system 20 according to the present embodiment, the oil return pipe 31 and the oil discharge pipe 32 are connected to the container 30 above the compression part 50 and below the motor 40. Specifically, the compression part 50 is a compression chamber. In the present embodiment, the low-stage compressor 21 is a two-cylinder compressor, and there are two compression chambers, the first compression chamber 71 and the second compression chamber 72. In such a case, the term compression chamber refers to the second compression chamber 72. Regarding the oil return pipe 31, the oil return pipe 31 is connected to the container 30 such that the oil is supplied to the space between the motor 40 and the compression part 50.

In the multistage compression system 20 according to the present embodiment, because the oil return pipe 31 is connected such that the oil is supplied to the space between the motor 40 and the compression part 50, the oil can be supplied quickly by the oil reservoir of the low-stage compressor. Further, because the oil discharge pipe 32 is connected to a position above the compression part 50 of the container 30 and below the motor 40, the excess oil of the low-stage compressor 21 can be discharged from the low-stage compressor without excess or deficiency. Therefore, the amount of oil in the low-stage compressor can be controlled more quickly.

(4-3)

In the multistage compression system 20 according to the present embodiment, the connecting portion of the oil return pipe 31 to the container 30 is as high as the connecting portion of the oil discharge pipe 32 to the container 30.

Therefore, in the multistage compression system 20 according to the present embodiment, the oil level of the oil reservoir of the low-stage compressor 21 is suppressed so as not to rise too high, and the amount of the oil in the low-stage compressor 21 is appropriately controlled.

(4-4)

In the multistage compression system 20 according to the present embodiment, in a top view, the connecting portion of the oil discharge pipe 32 to the container 30 is separated from the connecting portion of the oil return pipe 31 to the container by 90° or more in the rotation direction of the motor. The position is preferably separated by 180° or more.

Therefore, in the multistage compression system 20 according to the present embodiment, such a positional relationship between the oil discharge pipe 32 and the oil return pipe 31 reduces the oil introduced into the container 30 of the low-stage compressor 21 by the oil return pipe 31 to be discharged outside the container 30 directly by the oil discharge pipe 32, thereby appropriately controlling the amount of the oil in the low-stage compressor.

(4-5)

The compression part 50 of the low-stage compressor 21 of the multistage compression system 20 according to the present embodiment has the muffler 58*b*. The muffler 58*b* discharges the refrigerant compressed in the compression chambers 71 and 72 to the inside of the container 30. The muffler 58*b* has the discharge holes 58*c* and 58*d*. In a top view, the connecting portion of the oil discharge pipe 32 to the container 30 is the position opposite to the discharge holes 58*c* and 58*d* of the muffler 58*b* with respect to the axis RA of the motor 40. Here, the opposite position refers to a range of 180° other than a total of 180°, which is 90° to left and right of the axis RA from the connecting portion of the oil discharge pipe 32.

In the multistage compression system 20 according to the present embodiment, the connecting portion of the oil discharge pipe 32 to the container 30 is separated from positions of the discharge holes 58*c* and 58*d* of the muffler 58*b*. This can reduce the refrigerant discharged from the discharge holes 58*c* and 58*d* of the muffler 58*b* to be discharged from the low-stage compressor 21 directly by the oil discharge pipe 32.

(4-6)

In the multistage compression system 20 according to the present embodiment, the inner diameter of the oil discharge pipe 32 is equivalent to the inner diameter of the oil return pipe 31.

In the multistage compression system 20 according to the present embodiment, because the inner diameters of the oil discharge pipe 32 and the oil return pipe 31 are equivalent, it is easy to adjust an oil return amount and an oil discharge amount equally and to adjust the oil amount of the low-stage compressor.

(4-7)

In the multistage compression system 20 according to the present embodiment, the refrigerant is a refrigerant mainly including carbon dioxide, and the oil is oil insoluble with carbon dioxide. Examples of oil insoluble with carbon dioxide are polyalkylene glycols (PAG) and polyester esters (POE).

In such a mixed solution of insoluble-oil and carbon dioxide refrigerant, when the refrigeration apparatus 1 is operated under normal temperature conditions (−20° C. or higher), the oil is in a lower part and the refrigerant is in an upper part due to a specific gravity.

This makes it easy to separate the oil in the oil separator and return only the oil to the low-stage compressor 21. This also makes it easy to collect the liquid refrigerant above in the oil reservoir in the low-stage compressor 21 and discharge the excess liquid refrigerant from the oil discharge pipe 32.

(5) Modifications (5-1) Modification 1A

In the multistage compression system 20 according to the first embodiment, the connecting portion of the oil return pipe 31 to the container 30 is as high as the connecting portion of the oil discharge pipe 32 to the container 30. In the multistage compression system 20 of Modification 1A, the connecting portion of the oil return pipe 31 to the container 30 is higher than the connecting portion of the oil discharge pipe 32 to the container 30. The other configurations are the same as those in the first embodiment.

In the multistage compression system 20 of Modification 1A, the oil level in the oil reservoir of the low-stage compressor 21 is suppressed to be lower than that of the multistage compression system 20 according to the first embodiment. The amount of the oil in the low-stage compressor 21 is smaller than that in the first embodiment and is appropriately controlled.

(5-2) Modification 1B

In the multistage compression system 20 according to the first embodiment, the compressors 21 and 23 are both two-cylinder compressors. In the multistage compression system 20 of Modification 1B, the compressors 21 and 23 are both one-cylinder compressors. The other configurations are the same as those in the first embodiment.

The multistage compression system 20 of Modification 1A also has similar characteristics (4-1) to (4-7) to the multistage compression system 20 according to the first embodiment.

Further, when one of the low-stage compressor 21 or the high-stage compressor 23 is one-cylinder type and the other one is two-cylinder type, similar characteristics to those of the first embodiment are obtained.

(5-3) Modification 1C

In the first embodiment, the oil return pipe 31 returns the oil from the oil separator 25 to the low-stage compressor 21. In Modification 1C the oil return pipe 31 directly returns the oil discharged from the high-stage compressor 23 to the low-stage compressor 21. The other configurations are similar to those in the first embodiment.

The multistage compression system 20 of Modification 1C also has similar characteristics (4-1) to (4-7) to the multistage compression system 20 according to the first embodiment. However, in Modification 1A, the excess refrigerant and oil discharged from the high-stage compressor 23 are mixed, and thus the amount of refrigerant mixed in the oil flowing through the oil return pipe 31 is increased as compared with a case where the refrigerant passes through the oil separator 25 in the first embodiment.

Further, the oil separated from the oil separator 25 may be added to the oil discharged from the high-stage compressor 23 and returned to the container 30 of the low-stage compressor 21.

(5-4) Modification 1D

In addition to the configuration of the multistage compression system 20 according to the first embodiment, the multistage compression system of Modification 1D further includes a liquid level gauge measuring the amount of the oil in the oil reservoir of the low-stage compressor 21 and a control valve provided in the middle of the oil return pipe 31 and controlling a flow rate of the oil flowing through the oil return pipe 31. Then, based on liquid level data measured by the liquid level gauge, control is performed such that the flow rate of the control valve is decreased when the liquid level is higher than a predetermined value, and the flow rate of the control valve is increased when the liquid level is lower than a predetermined value.

The multistage compression system of Modification 1D includes the liquid level gauge and the control valve, and can perform feedback control of the oil amount of the low-stage compressor 21 using the oil return pipe 31. The multistage compression system 20 of Modification 1D also has similar characteristics (4-1) to (4-7) to the multistage compression system 20 according to the first embodiment.

(5-5) Modification 1E

The multistage compression system 20 according to the first embodiment has a two-stage compression system of the low-stage compressor 21 and the high-stage compressor 23. The multistage compression system of Modification 1E is a four-stage compression system having four compressors. In Modification 1E, the compressor on a lowest stage corresponds to the low-stage compressor 21 according to the first embodiment, the compressor on a highest stage corresponds to the high-stage compressor 23 according to the first embodiment, and the discharge pipes of the three compressors on a low stage correspond to the intermediate pressure refrigerant pipe 15 according to the first embodiment.

The multistage compression system 20 of Modification 1E also has similar characteristics (4-1) to (4-7) to the multistage compression system 20 according to the first embodiment.

The multistage compression system 20 of Modification 1E is a multistage compression system in which four compressors are connected in four stages. The present disclosure is also effective when a multistage compression system in which three compressors are connected in three stages, and when a multistage compression system in which five or more compressors are connected in five or more stages.

(5-6) Modification 1F

The multistage compression system 20 according to the first embodiment includes the intercooler 26 upstream of the intermediate pressure refrigerant pipe 15 connected to the discharge pipe 15*a* of the low-stage compressor 21 and the merging part 15*b* of the intermediate injection pipe downstream of the intermediate injection pipe 15. The multistage compression system 20 of Modification 1F includes the merging part 15*b* of the intermediate injection pipe upstream of the intermediate pressure refrigerant pipe 15 and the intercooler 26 downstream of the intermediate pressure refrigerant pipe 15. The other configurations are the same as those in the first embodiment.

The multistage compression system 20 of Modification 1F also has similar characteristics (4-1) to (4-7) to the multistage compression system 20 according to the first embodiment.

(5-7) Modification 1G

The multistage compression system 20 according to the first embodiment includes the intercooler 26 upstream of the intermediate pressure refrigerant pipe 15 connected to the discharge pipe 15*a* of the low-stage compressor 21 and the merging part 15*b* of the intermediate injection downstream of the intermediate injection pipe 15. In the multistage compression system 20 of Modification 1G, only the intercooler 26 is provided in the intermediate pressure refrigerant pipe 15, but the merging part 15*b* of the intermediate injection pipe is not provided. Modification 1G does not include the economizer heat exchanger 7. The other configurations are similar to those in the first embodiment.

The multistage compression system 20 of Modification 1G also has similar characteristics (4-1) to (4-7) to the multistage compression system 20 according to the first embodiment.

Further, contrary to Modification 1G, the present disclosure is also effective when the multistage compression system 20 only includes the intermediate injection merging part 15*b* in the intermediate pressure refrigerant pipe 15 and does not include the intercooler 26.

(5-8) Modification 1H

In the multistage compression system 20 according to the first embodiment, the oil discharge pipe 32 is connected to downstream of the merging part 15*b* of the intermediate injection on the intermediate pressure refrigerant pipe 15. In Modification 1H, the oil discharge pipe 32 is connected upstream of the intercooler 26 on the intermediate pressure refrigerant pipe 15. At the merging part, a pressure difference between the oil discharge pipe 32 and the intermediate pressure refrigerant pipe 15 is smaller in Modification 1H than in the first embodiment. Therefore, the oil discharge amount is smaller in Modification 1H than in the first embodiment. Consequently, the amount of oil in the low-stage compressor is controlled to be larger in Modification 1H than in the first embodiment. The other configurations and characteristics are similar to those in the first embodiment.

Further, the oil discharge pipe 32 may be connected between the intercooler 26 and the merging part 15*b* of the intermediate injection on the intermediate pressure refrigerant pipe 15, or in a middle of the intercooler 26. The oil discharge amount of the oil discharge pipe 32 changes depending on the connecting portion on the intermediate pressure refrigerant pipe 15, but even in that case, the other configurations and characteristics are also similar to those in the first embodiment.

(5-9) Modification 1I

In the multistage compression system 20 according to the first embodiment, the rotary compression part of the compressor 21 has the first piston 56 in which the annular part 56*a* and the blade 56*b* are integrated. The rotary compression part of Modification 1I has a vane instead of a blade, and the vane and the piston are separate bodies. The other configurations are similar to those in the first embodiment.

The multistage compression system 20 of Modification 1I also has similar characteristics (4-1) to (4-7) to the multistage compression system 20 according to the first embodiment.

(5-10) Modification 1J

In the multistage compression system 20 according to the first embodiment, the receiver 6 and the economizer heat exchanger 7 are disposed upstream of the intermediate injection pipe. In the multistage compression system 20 of Modification 1J, only the receiver 6 is provided upstream of the intermediate injection pipe 12, and the economizer heat exchanger 7 is not provided. The other configurations are similar to those in the first embodiment.

The multistage compression system 20 of Modification 1J also has similar characteristics (4-1) to (4-7) to the multistage compression system 20 according to the first embodiment.

Further, contrary to Modification 1J, the present disclosure is also effective when the multistage compression system 20 only includes the economizer heat exchanger 7 upstream of the intermediate injection pipe 12 and does not include the receiver 6.

The foregoing description concerns the embodiments of the present disclosure. It will be understood that numerous modifications and variations may be made without departing from the gist and scope of the present disclosure in the appended claims.

What is claimed is:

1. A multistage compression system using refrigerant and oil, the multistage compression system comprising: a low-stage compressor configured to compress and discharge the refrigerant, a high-stage compressor configured to further compress the refrigerant compressed by the low-stage compressor; an intermediate pressure refrigerant pipe that receives the refrigerant discharged from the low-stage compressor; a suction pipe that delivers the refrigerant to the low-stage compressor; an oil return pipe configured to return oil discharged by the high-stage compressor to the low-stage compressor; and an oil discharge pipe configured to discharge oil in the low-stage compressor, the low-stage compressor including a low-stage compression part configured to compress the refrigerant, a low-stage motor arranged and configured to drive the low-stage compression part, and a low-stage container that houses the low-stage compression part and the low-stage motor, the low-stage container forming a high-pressure space storing compressed refrigerant, the high-stage compressor including a high-stage compression part, a high-stage motor and a high-stage container that are separate from the low-stage compression part, the low-stage motor, and the low-stage container, an inside of the oil return pipe and an inside of the oil discharge pipe being connected to the high-pressure space, and each of the intermediate pressure refrigerant pipe, the suction pipe, the oil return pipe, and the oil discharge pipe beige connected to the low-stage container at a different position, the oil return pipe and the oil discharge pipe being connected to the low-stage container above the low-stage compression part and below the low-stage motor.

2. The multistage compression system according to claim 1, wherein a connecting portion of the oil return pipe connected to the low-stage container is as high as a connecting portion of the oil discharge pipe connected to the low-stage container.

3. The multistage compression system according to claim 1, wherein in a top view, a connecting portion of the oil discharge pipe connected to the low-stage container is at a position separated by 90° or more in a rotation direction of the low-stage motor from a connecting portion of the oil return pipe connected to the low-stage container.

4. The multistage compression system according to claim 3, wherein in a top view, the connecting portion of the oil discharge pipe connected to the low-stage container is at a position separated by 180° or more in the rotation direction of the low-stage motor from the connecting portion of the oil return pipe connected to the low-stage container.

5. The multistage compression system according to claim 1, wherein the oil discharge pipe has a diameter equivalent to a diameter of the oil return pipe.

6. The multistage compression system according to claim 1, wherein the refrigerant mainly includes carbon dioxide, and the oil is insoluble in carbon dioxide.

7. The multistage compression system according to claim 1, further comprising: a refrigerant pipe arranged and configured to introduce refrigerant compressed and discharged from the low-stage compressor to a suction portion of the high-stage compressor; and an accumulator disposed between the refrigerant pipe and the intermediate pressure refrigerant pipe, the oil discharge pipe communicating between the low-stage compressor and the intermediate pressure refrigerant pipe.

8. The multistage compression system according to claim 1, wherein a connecting portion of the oil return pipe connected to the low-stage container is higher than a connecting portion of the oil discharge pipe connected to the low-stage container.

9. A multistage compression system using refrigerant and oil, the multistage compression system comprising: a low-stage compressor configured to compress and discharge the refrigerant, a high-stage compressor configured to further compress the refrigerant compressed by the low-stage compressor; an intermediate pressure refrigerant pipe that receives the refrigerant discharged from the low-stage compressor; a suction pipe that delivers the refrigerant to the low-stage compressor; an oil return pipe configured to return oil discharged by the high-stage compressor to the low-stage compressor; and an oil discharge pipe configured to discharge oil in the low-stage compressor, the low-stage compressor including a low-stage compression part configured to compress the refrigerant, a low-stage motor arranged and configured to drive the low-stage compression part, and a low-stage container that houses the low-stage compression part and the low-stage motor, the low-stage container forming a high-pressure space storing compressed refrigerant, the high-stage compressor including a high-stage compression part, a high-stage motor and a high-stage container that are separate from the low-stage compression part, the low-stage motor, and the low-stage container, an inside of the oil return pipe and an inside of the oil discharge pipe being connected to the high-pressure space, and each of the intermediate pressure refrigerant pipe, the suction pipe, the oil return pipe, and the oil discharge pipe beige connected to the low-stage container at a different position, and a connecting portion of the oil return pipe connected to the low-stage container being higher than a connecting portion of the oil discharge pipe connected to the low-stage container.

10. The multistage compression system according to claim 9, wherein in a top view, the connecting portion of the oil discharge pipe connected to the low-stage container is at a position separated by 90° or more in a rotation direction of the low-stage motor from the connecting portion of the oil return pipe connected to the low-stage container.

11. A multistage compression system using refrigerant and oil, the multistage compression system comprising: a low-stage compressor configured to compress and discharge the refrigerant, a high-stage compressor configured to further compress the refrigerant compressed by the low-stage compressor; an intermediate pressure refrigerant pipe that receives the refrigerant discharged from the low-stage compressor; a suction pipe that delivers the refrigerant to the low-stage compressor; an oil return pipe configured to return oil discharged by the high-stage compressor to the low-stage compressor; and an oil discharge pipe configured to discharge oil in the low-stage compressor, the low-stage compressor including a low-stage compression part configured to compress the refrigerant, a low-stage motor arranged and configured to drive the low-stage compression part, and a low-stage container that houses the low-stage compression part and the low-stage motor, the low-stage container forming a high-pressure space storing compressed refrigerant, the low-stage compression part including a compression chamber configured such that the refrigerant is introduced into the compression chamber and compressed, a muffler provided with a discharge hale configured to discharge the refrigerant compressed in the compression chamber, the high-stage compressor including a high-stage compression part, a high-stage motor and a high-stage container that are separate from the low-stage compression part, the low-stage motor, and the low-stage container, an inside of the oil return pipe and an inside of the oil discharge pipe being connected to the high-pressure space, and each of the intermediate pressure refrigerant pipe, the suction pipe, the oil return pipe, and the oil discharge pipe beige connected to the low-stage container at a different position, and in a top view, a position of the discharge hole of the muffler being such that more than half a total area of the discharge hole is located outside a range of 180°, the range being defined to be 90° to the left and right of a connecting portion of the oil discharge pipe about a rotation center of the low-stage motor.

* * * * *